United States Patent [19]

Ringe

[11] 3,989,289

[45] Nov. 2, 1976

[54] DOOR HARDWARE

[75] Inventor: Stephen J. Ringe, Detroit, Mich.

[73] Assignee: Fruehauf Corporation, Detroit, Mich.

[22] Filed: Apr. 9, 1975

[21] Appl. No.: 566,237

[52] U.S. Cl. ..... 292/241; 292/67; 292/218; 292/DIG. 32; 292/DIG. 55

[51] Int. Cl.[2] ..... E05C 3/14

[58] Field of Search ..... 292/218, 341.13, 241, 292/67, DIG. 32, DIG. 55, DIG. 39; 49/472, 395

[56] References Cited

UNITED STATES PATENTS

| | | | |
|---|---|---|---|
| 621,318 | 3/1899 | Brachhausen | 292/241 |
| 1,019,036 | 3/1912 | Gaines | 292/DIG. 32 |
| 1,300,143 | 4/1919 | Elliott | 49/472 X |
| 2,422,723 | 6/1947 | Fisher | 292/241 X |
| 3,134,618 | 5/1964 | Heimann | 292/DIG. 32 |
| 3,642,314 | 2/1972 | Smith et al. | 292/240 X |
| 3,801,146 | 4/1974 | Donath et al. | 292/218 |
| 3,806,173 | 4/1974 | Sweda | 292/DIG. 32 |

FOREIGN PATENTS OR APPLICATIONS

| | | | |
|---|---|---|---|
| 604,713 | 9/1960 | Canada | 292/241 |
| 1,249,311 | 10/1971 | United Kingdom | 292/218 |

*Primary Examiner*—Roy D. Frazier
*Assistant Examiner*—Rodney H. Bonck
*Attorney, Agent, or Firm*—Harness, Dickey & Pierce

[57] ABSTRACT

A generally arcuate camming finger is disposed at each end of a vertical lock rod which is rockable about its axis and which extends above and below the edges of a door of a cargo vehicle body such as an enclosed freight-hauling semi-trailer, or a large container for cargo. The lock rod has a horizontally extending operating handle that locks against the outer surface of the door in the conventional manner. As the door completes its closing movements, each finger enters an opening in a hollow keeper housing secured to the header or sill of the door opening, and when the lock rod is rotated exerts a camming force by engagement with a keeper pin to produce the final movement of the door to closed and locked position. The door has a reinforcing rib which carries one half of an anti-rack mechanism the other half of which is associated with a keeper housing which carries the keeper pin.

3 Claims, 8 Drawing Figures

DOOR HARDWARE

BACKGROUND OF THE INVENTION

Reference may be had to U.S. Pat. No. 3,806,173 (assigned to the assignee of the present invention) to show the general arrangement of a door closure and lock rod mechanism of the type with which the present invention is concerned.

An important object of the present invention is to provide an improved, simple and rugged locking mechanism of the indicated class which, in and near the locked position, allows some rotation of the lock rod and cam while maintaining its full locking capability. A related object is to provide an improved mechanism of the type indicated which facilitates placing the lock rod actuating handle in its holder under conditions rendering this difficult with known mechanisms. A further object is to provide such an improved mechanism incorporating means which exerts a torque in the locking direction on the cam and connected parts in response to an opening force on the locked door. Another object is to provide improved anti-rack means for such a cargo body or container.

Other objects and advantages will become apparent upon consideration of the present disclosure in its entirety.

DESCRIPTION OF THE PREFERRED EMBODIMENTS

Figure 1:
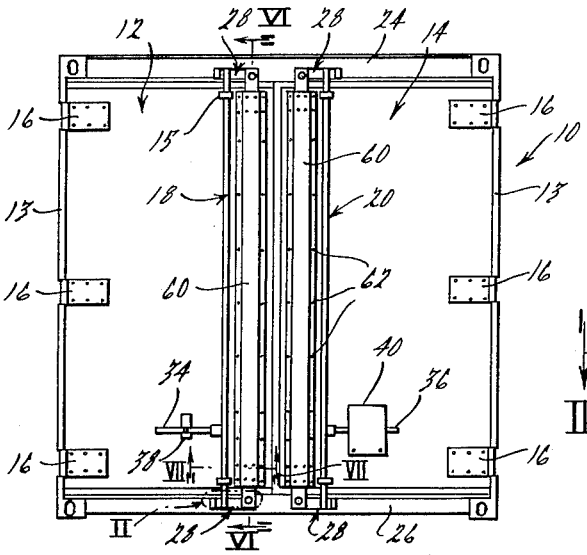
FIG. 1 is a view in elevation of the rear face of a trailer, truck body or container having door hardware thereon incorporating the present invention.
Figure 2:
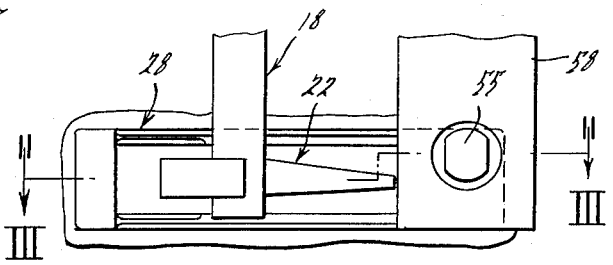
FIG. 2 is a view on a larger scale of the structure illustrated within the area II of FIG. 1.

The body, 10, of a trailer, truck or container is fragmentarily illustrated to typify the environment wherein this invention is used. A pair of doors 12 and 14 are hinged to rigid doorposts or jambs 13 at the rear corners of the body 10 by a plurality of hinges 16. Each of the doors 12, 14 carries near its free edge a vertical lock operating rod 18, 20 mounted in bearing brackets 15 for rotation about their respective axes. The rods 18, 20 extend above and below the doors so as to overlie the header 24 and sill 26 when the doors are closed. A locking cam 22 is fast upon each projecting end of each lock rod and as the door reaches and moves away from its fully closed position the cam is swingable, by rocking the lock rod, into and out of a cavity 30 defined by a keeper housing 28, one of which is provided for each cam. The keeper housings are rigid, rearwardly opening box-like castings fitted into openings as 29 in the sill and header and having flanges 31 which overlie and are welded or otherwise firmly secured to the sill or header. Only one locking cam 22 and housing 28 will be described in conjunction with the rod 18, it being understood that four cam and housing combinations are utilized to lock the doors 12 and 14.

Figure 3:
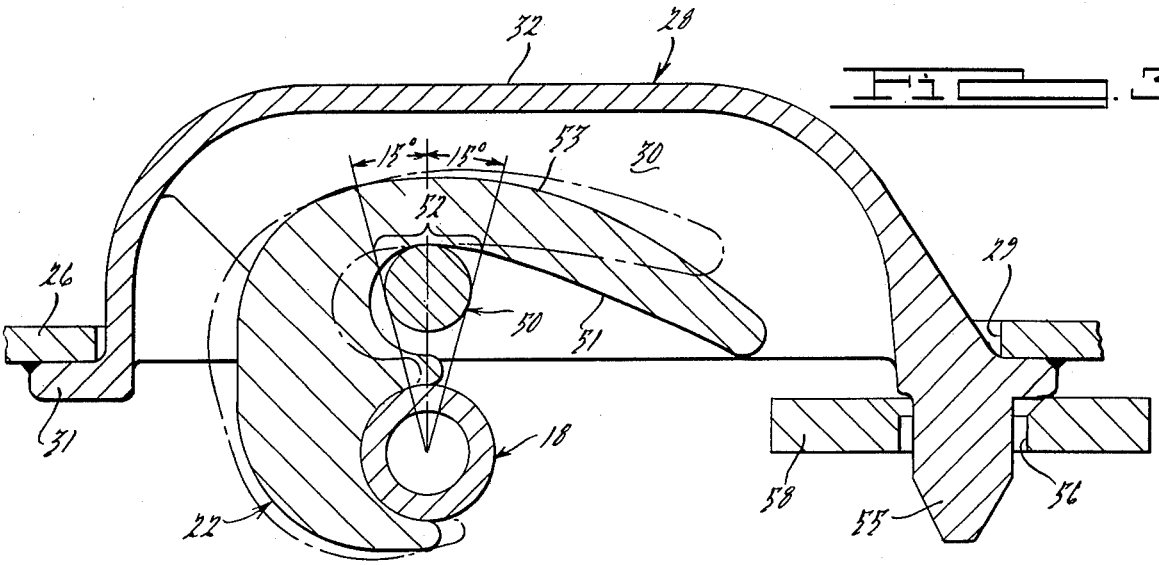
FIG. 3 is a further enlarged sectional view of the structure illustrated in FIG. 2 taken on the line III—III thereof.
Figure 4:
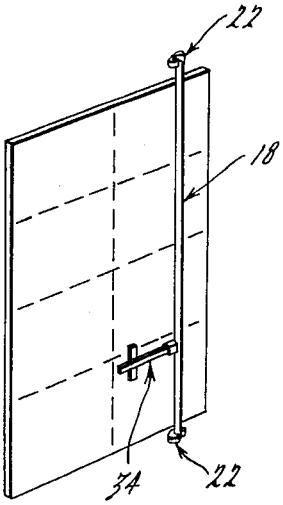
FIG. 4 is a diagrammatic perspective view of a door of FIG. 1 in its normal condition.
Figure 5:
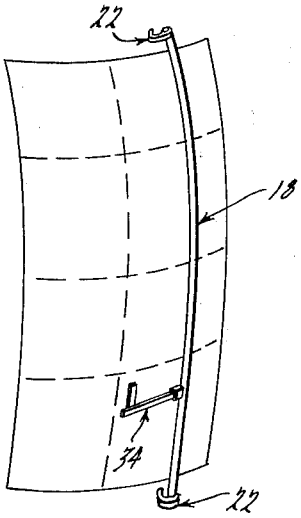
FIG. 5 is a view similar to FIG. 4 but showing the door of FIG. 1 when subjected to a bulge load.
Figure 6:
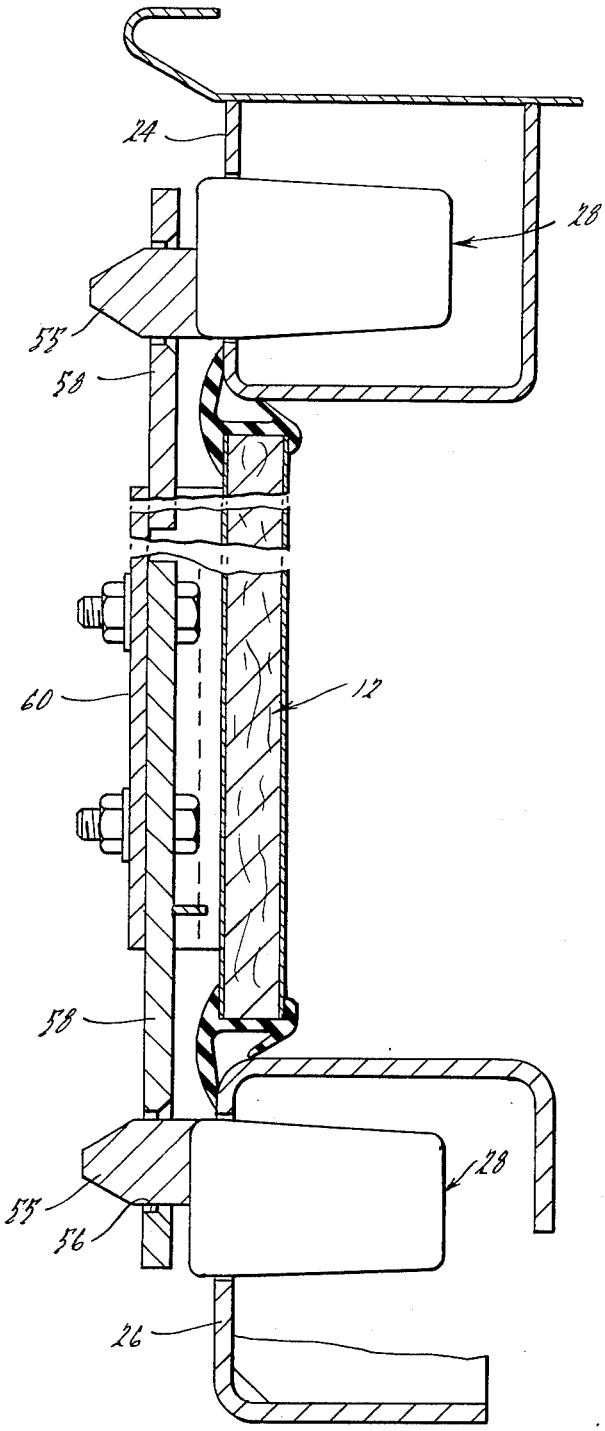
FIg. 6 is a vertical sectional view taken substantially on the line VI—VI of FIG. 1, on a larger scale and looking in the direction of the arrows, partly broken away.

The cavity 30 defined by the keeper housing is somewhat wider in a vertical direction than the locking cam and located to align therewith and proportioned to receive the cam as the door reaches its closed position. As shown in FIG. 3, the cam is then swingable to overengaged holding position with respect to a cylindrical keeper abutment pin 50 in the keeper housing. Each of the rods 18 and 20 has an operating handle 34, 36 respectively, secured thereto against rotation around the axis of the rod but pivoted thereto on a horizontal axis for vertical movement so that it can be engaged and secured with respect to the door by means of conventional locking brackets 38 and 40, respectively when the cams are in the locked position, thereby securing the locking means against accidental release. The keeper pin 50 is secured in and bridges the horizontal top and bottom walls of the housing.

In the construction shown in FIGS. 1–7 when the door is closed the axes of the lock rod and keeper pin lie on a vertical plane perpendicular to the plane of the door opening. The hook-like inner surface 51 of the cam is shaped to pull the door inwardly toward the fully closed position during the final portion of closing movement but the fully-closed position of the door is reached approximately 30° before the cam is fully overengaged, that is, prior to the position corresponding to the locked condition wherein the actuating handle, 34 or 36, is engageable with its holding means 38 or 40 on the door. The portion of surface 51 corresponding to the final 30° of movement is designated 52 in a bracketed area of FIG. 3 which refers to the dot-dash position of the cam as shown in that view. Surface portion 52 is concentric with the axis of the lock rod 18, although of greater radius, as shown. Thus no opening force exerted on the door can exert any torque on the cam which would tend to rock it to its unlocked position, and the final movement of the handle is rendered relatively easy, facilitating the securing thereof. If the door is bulged by a heavy force from inside, such as might result from shifting cargo, the lock operating handle is, in effect, thereby moved outwardly, from the normal or undistorted plane of the door, farther than the lock rod, since the free edge of the door is restrained by the cams on the rod. Although this has the effect of rocking the cams toward the released position, such bulging is accommodated within the concentric areas 52, so that there is no tendency to cause the door locking means to release by moving the cams far enough so that the reaction between the keeper pins and cams could cause the cams to swing to the released position.

The cams are substantially longer than the distance between rod 18 and the side of pin 50 farthest from the rod, as shown. It will also be noted that if the cams are swung toward the released position while the door is fully closed, the rear surface 53 of each cam will strike the back wall 32 of the keeper housing. The cams are thus effective to pry the door open if it should be wedged or stuck due to icing conditions or the like.

The cams are tapered to decreasing thickness in the vertical direction toward their ends, and the keeper housings and keeper pins substantially exceed in their vertical dimensioning the thickness of the cams, so that the cams, which are also relatively long, are effective to engage the keepers and to pull the doors closed even though the door frame is racked. It will be seen that the final closing also tends to straighten any such racked condition and to pull the anti-rack parts into overengaged relation. The anti-rack parts, one of which is appurtenant to each keeper housing, comprise a rigid pin-like projection, 55, having a tapered outer end, integral with and projecting outwardly from each keeper housing at its end closest to the free edge of the door. When the door is closed, the anti-rack pin portion 55 is overfitted by an aperture 56 in a rigid tongue 58 attached to the door.

Each tongue 58 is formed of a stiff steel plate fitted into and rigidly secured to a double-bent stiffening rib member 60 attached to the outer face of the door near its free edge and extending the full height of the door. As shown, the rib members define a vertical channel of rectangular section, open at the top and bottom of the door, and the tongues are bolted thereto and project upwardly or downwardly, as the case may be, to overlie the anti-rack pin area when the door is closed. The apertures 56 in the tongues fit relatively closely on the pins 55 and if rack-type distortion exists, are guided thereonto by the tapered ends of the pins and such parts thereby act to straighten the body. Racking forces and the forces required to straighten the body when diamond or so-called rack-type distortion has occurred are transmitted longitudinally through the stiffening ribs and are not imposed on localized areas of the doors. The ribs are attached to the doors at a relatively large number of positions, as by means of the bolts 62. Thus the load on the door created by racking forces, and by the straightening action of the anti-rack means, is distributed over a large area.

Figure 8:
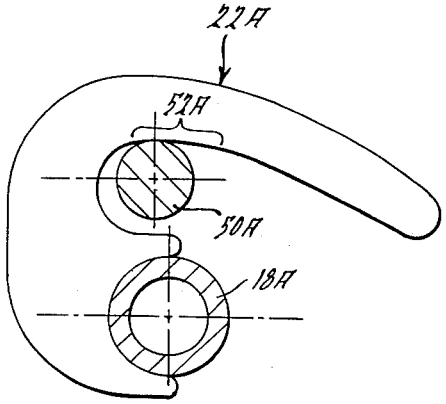
FIG. 8 is a horizontal sectional view showing the keeper pin, lock rod and cam of a modified construction.
Figure 7:
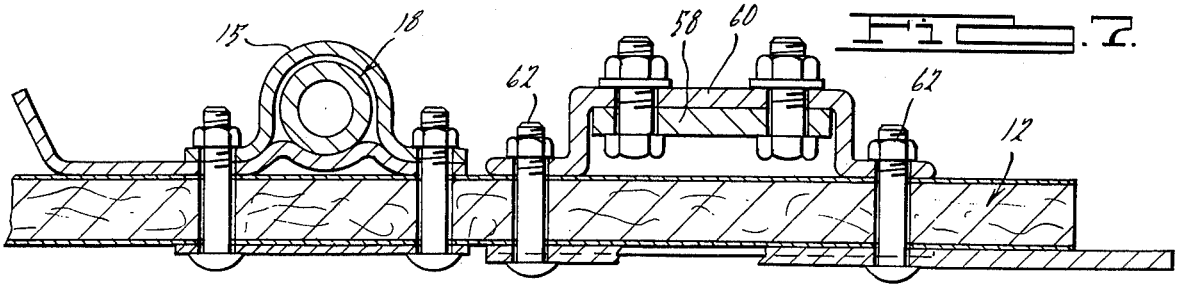
FIG. 7 is a horizontal section taken substantially on the line VII—VII of FIG. 1, on a larger scale and looking in the direction of the arrows.

In the modified construction shown in FIG. 8, wherein parts similar to those already described are designated by like reference characters distinguished by the addition of the letter "A", the lock rod 18A and cam 22A are shown in the relative positions they would occupy if carried by the left or roadside door 12 of FIG. 1. The keeper pin 50A is positioned slightly to the left of the closed position of the lock rod, rather than directly forward thereof as in the first-described embodiment, or in other words, farther from the free end of the cam than is the lock rod 18A, considered in a line parallel to the plane of the door. The portion 52A of camming surface 51A is concentric with the axis of the lock rod, however, as in the first embodiment. When an opening force is exerted on the door, the resultant reactive force on the keeper pin tends to move the cam clockwise, as viewed in FIG. 8, or toward the locked position. It will be seen that this self-tightening effect is achieved with no additions or changes other than a slight change of placement of the keeper pin.

This Description of the Preferred Embodiments of the invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. In combination with a door frame structure defining a door opening and including a sill, a header and jambs, and a door hinged thereto, particularly for a cargo vehicle body or the like, fastening means for the door comprising a rod rotatably supported on and extending transversely of the door and projecting beyond a free edge thereof at a position spaced from the hinged edge of the door, a generally cylindrical keeper abutment portion supported on the frame structure and extending parallel to the rod and located at a position which when the door is closed is close to the projecting portion of the rod and in an overlapping axially offset relation thereto, characterized by a hook-like locking cam secured to and extending laterally from the rod and rotatable by the rod into and out of overengaged holding relation with respect to the keeper abutment portion when the door is at and near the closed position, said cam having a free end which when the door is closed is farther from the rod and from the keeper abutment portion than the distance between the rod and the side of the keeper abutment portion farthest from the rod, said locking cam having a camming inner surface extending angularly non-radially from the free end of the cam toward the rod and terminating at an arcuate holding portion which is concentric with the axis of the rod but of a radius substantially exceeding that of the rod, the radius of the keeper abutment portion being substantially shorter than that of said arcuate holding portion, the cam being fast on the rod, and an operating handle attached to the rod and swingable to and from the door to rotate the cam into and out of overengaged relation, further characterized in that when the handle is fully moved toward the door and the cam is in its normal fully overengaged holding position, said concentric holding portion of the camming surface extends toward the free end of the cam for a substantial distance beyond the position of contact between the cam and the keeper abutment portion.

2. In combination with a rectangular frame structure defining a door opening and including a sill, a header, jambs, a door hinged to one of the jambs, and means for securing the door in closed position, particularly for a cargo vehicle body or the like, means for counteracting distortion of the doorframe structure including a box-like stiffening rib member extending parallel to the hinge axis at a position spaced therefrom for substantially the full length of the free edge of the door and secured to the door at a plurality of positions, characterized by anti-rack portions carried by said rib member and interengageable when the door is closed with coacting anti-rack portions carried by the sill and header, said anti-rack portions comprising pin and socket-type parts interengageable along lines perpendicular to the plane of the door opening and including a pair of such parts coacting with the sill and another pair coacting with the header, including a rigid member secured in and projecting from each end of said rib, the member at one end overlying the sill and at the other end overlying the header, each of said projecting ends carrying one half of said paired pin and socket-type parts.

3. A combination as defined in claim 2 wherein separate rigid members are provided at each end, each such member having an aperture therein defining the socket part.

* * * * *